United States Patent [19]

Orton

[11] Patent Number: 4,624,033

[45] Date of Patent: Nov. 25, 1986

[54] CHILD SAFETY SEATBELT SECUREMENT DEVICE

[76] Inventor: Dale W. Orton, R.R. 2 Box 21, Elkhorn, Nebr. 68022

[21] Appl. No.: 787,661

[22] Filed: Oct. 15, 1985

[51] Int. Cl.[4] ..... A44B 17/00

[52] U.S. Cl. ..... 24/633; 24/634; 24/664; 24/573

[58] Field of Search ..... 24/633, 634, 636, 637, 24/647, 649, 651, 656, 664, 644, 173, 573, 574

[56] References Cited

U.S. PATENT DOCUMENTS

| | | | |
|---|---|---|---|
| 2,543,933 | 3/1951 | Pommier | 24/636 |
| 2,688,173 | 9/1954 | Van Peet | 24/634 |
| 3,127,650 | 4/1964 | Seward | 24/68 |
| 3,285,659 | 11/1966 | Robbins | 297/385 |
| 3,318,634 | 5/1967 | Nicholas | 297/388 |
| 3,484,908 | 12/1969 | Lamb | 24/574 |
| 3,513,510 | 5/1970 | Copes | 24/656 |
| 3,522,636 | 8/1970 | Klink | 24/639 |
| 3,711,154 | 1/1973 | Merola | 297/468 |
| 3,716,895 | 2/1973 | Fohr | 24/664 |
| 3,774,268 | 11/1973 | Holmberg | 24/230 |
| 3,886,632 | 6/1975 | Bako | 24/173 |
| 3,992,057 | 11/1976 | Studebaker | 297/468 |
| 4,062,091 | 12/1977 | Holmberg | 24/637 |
| 4,466,162 | 8/1984 | Pogharian et al. | 24/664 |
| 4,497,094 | 2/1985 | Morris | 24/633 |
| 4,502,194 | 3/1985 | Morris et al. | 24/633 |
| 4,539,736 | 9/1985 | Yokosuka | 24/644 |

FOREIGN PATENT DOCUMENTS

| | | | |
|---|---|---|---|
| 146274 | 6/1936 | Fed. Rep. of Germany | 24/634 |
| 218779 | 7/1924 | United Kingdom | 24/656 |

*Primary Examiner*—Victor N. Sakran

*Attorney, Agent, or Firm*—Zarley, McKee, Thomte, Voorhees & Sease

[57] ABSTRACT

The child safety seatbelt securement device of the present invention includes a housing adapted for at least partially covering the release button of a female seatbelt buckle so that direct access to the release button is substantially restricted. The housing includes a mechanism for releasably securing it onto a conventional female seatbelt buckle. Finally, the housing includes an actuator mechanism which is actuatable by an adult for depressing the release button of the female seatbelt buckle on which the housing is secured. The same actuator mechanism is difficult, if not impossible, for a young child to operate, however, due to its complicated or multi-step operation or the force required for actuating it.

14 Claims, 15 Drawing Figures

CHILD SAFETY SEATBELT SECUREMENT DEVICE

BACKGROUND OF THE INVENTION

The present invention is directed generally to a device for covering the release button on the female buckle of an automotive seatbelt for preventing a child from releasing his own seatbelt yet allowing the seatbelt to be quite easily released by an adult.

Motor vehicle accidents are the leading cause of death and crippling injury for children in the United States. Every year, approximately 650 children under age five die of injuries sustained while riding as passengers in automobiles. Another 50,000 children in the same age group suffer injury severe enough to warrant visits to an emergency room. It is thought that if every child under age five were placed in a child restraint device for every car ride, mortality could be cut by 90% and serious injury by over 65% when accidents occur. Studies from the State of Washington over a ten year period indicate that a child who is harnessed in a child restraint device, or even with an adult seatbelt, has a 1 in 3000 risk of being killed in the event of a crash, whereas the risk for a nonrestrained child jumps to 1 in 200.

Simply placing a child in a seatbelt will be ineffective, however, unless the seatbelt remains latched and on the child throughout the car ride. Because conventional seatbelts are rather easily disengaged by simply pressing a release button on one of the buckle portions, young children of approximately one and a half years of age can easily figure out and disengage the seatbelts. On the other hand, they are not old enough to understand that the seatbelt should remain engaged for their safety. Accordingly, there is a need for a device which can be attached to a conventional seatbelt buckle for blocking access to the release button by a child. The same device, however, must be easily actuatable by an adult for disengaging the seatbelt.

Many child restraint devices are designed to be held in place on an automotive seat by the conventional seatbelt. Such devices can be rendered useless and dangerous if a child seated in the device can disengage the seatbelt. The unsecured child restraint device simply serves to support the child at a higher elevation and becomes another projectile in the event of an impact.

A primary object of the invention therefore is to provide a child safety seatbelt securement device adapted for at least partially covering the release button of a female seatbelt buckle to prevent disengagement of the seatbelt by a child, yet which is easily actuated by an adult for disengaging the seatbelt.

Another object is to provide such a seatbelt securement device which is easily installed on conventional seatbelts.

Another object is to provide such a seatbelt securement device which is simple and rugged in construction, economical to manufacture and efficient in operation.

SUMMARY OF THE INVENTION

The child safety seatbelt securement device of the present invention is adapted for use with a female seatbelt buckle of the type having an opening in one end for receiving a male seatbelt buckle and a depressible release button on the top surface thereof. The device includes a housing adapted for at least partially covering the release button of a female seatbelt buckle so that direct access to the release button is substantially restricted. The housing can take many forms including a sleeve slidable over one of the seatbelt buckles or even a channel or plate adapted to be clamped or otherwise secured onto the top surface of the female seatbelt buckle. Some form of actuator mechanism on the device is operable by an adult for depressing the release button of the female seatbelt buckle. The same actuator mechanism is difficult, if not impossible for a young child to operate, however, due to its complicated or multi-step operation or the force required for actuating it.

The invention may take many forms, a preferred embodiment including a housing adapted to receive the female seatbelt buckle in a lower portion thereof and having a releasable actuating mechanism in an upper portion thereof. The actuating mechanism may include an actuator button positioned in registration with the seatbelt buckle release button for engaging the same. One or more lock fingers are spring-biased to a locked position in engagement with the actuator button to prevent downward movement of the button for depressing the release button. Upon manual disengagement of the lock fingers from the actuator button, that button can be pressed downwardly for disengaging the seatbelt.

In another embodiment, a single sleeve housing has a top wall opening in registration with the release button and a plate-like cover which is either hinged or slidably mounted on the top wall for movement between a locked position covering the access opening and a release position in clearance relation from the access opening. The plate may have one or more flexible fingers insertable into a socket on the housing for retaining the plate in its locked position. An additional flexible lock tab may engage the top of the plate so that access to the release button of the seatbelt requires release of both the lock tab and flexible fingers. This is easily accomplished by an informed adult but would be very difficult to a young child to figure out or accidentally open.

Yet another embodiment simply includes a cover plate secured over the top of the female seatbelt latch with a very small opening in registration with the release button such that a removable key is necessary for insertion through the opening to disengage the seatbelt. A similar embodiment includes no such keyhole but rather has a somewhat rigid top wall with a thickened central portion in registration with the release button such that a rather substantial pressure on the top plate is required to flex it sufficiently for depressing the seatbelt release button.

DETAILED DESCRIPTION OF THE PREFERRED EMBODIMENTS

Figure 1:
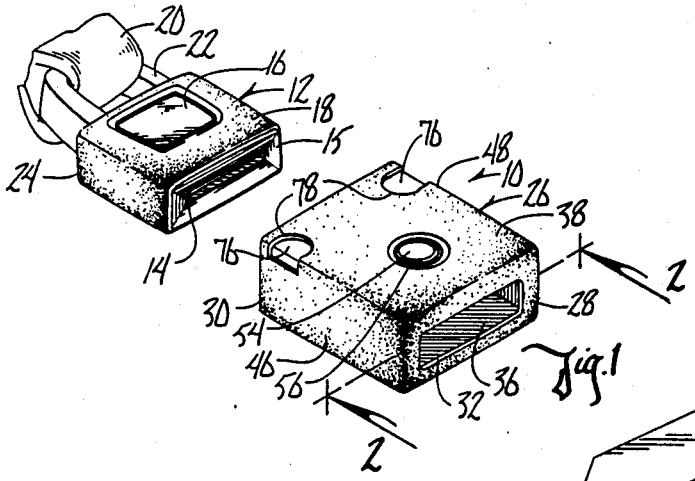
FIG. 1 is a perspective view of the seatbelt securement device positioned for receiving the female buckle portion of a seatbelt.

The child safety seatbelt securement device 10 of the present invention is shown in FIG. 1 positioned in alignment with a female seatbelt buckle 12 of the type having an opening 14 in one end for receiving a male seatbelt buckle therein and a depressable release button 16 on the top surface 18 thereof. One end of a seatbelt 20 is folded through and secured to the belt securement loop 22 on the opposite end 24 of buckle 12. The female seatbelt buckle 12 is conventional.

The device 10 of the present invention includes a housing 26 which is adapted for at least partially covering the release button 16 of buckle 12 so that direct access to the release button is substantially restricted. Housing 26 has open opposite ends for permitting access to the female seatbelt buckle opening 14 through one end 28 and for extension of the buckle 12 or seatbelt 20 through the opposite end 30. Opening 32 through end 28 is of reduced size so that the buckle 12 abuts against end 28 upon insertion of the buckle into the housing 26. The opening 34 through opposite end 30 is large enough to permit passage of the buckle into the housing.

Figure 2:
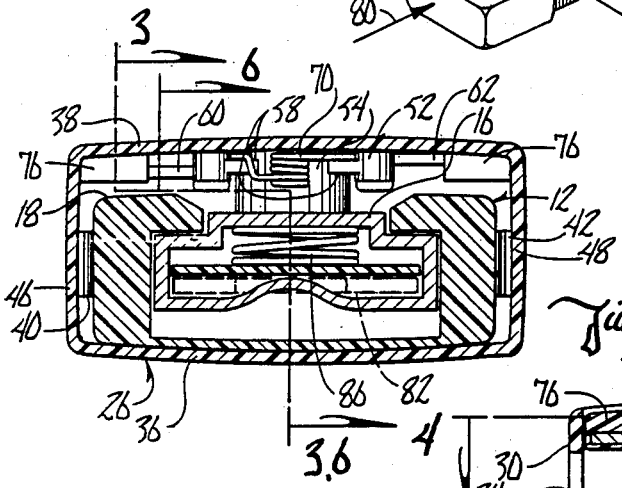
FIG. 2 is an end sectional view of the assembled securement device and female buckle portion, taken along line 2—2 in FIG. 1.
Figure 3:
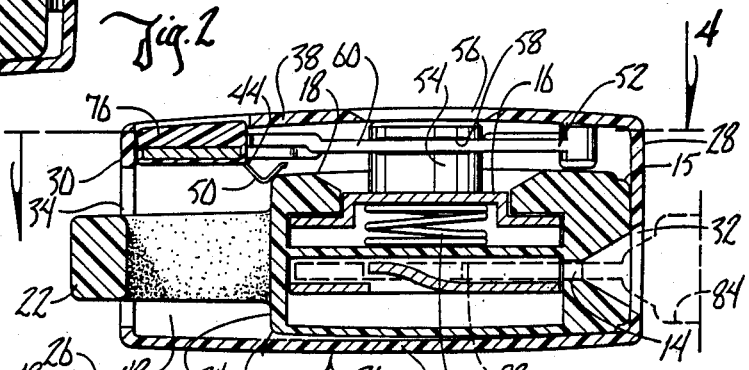
FIG. 3 is a side sectional view taken along line 3—3 in FIG. 2.
Figure 4:
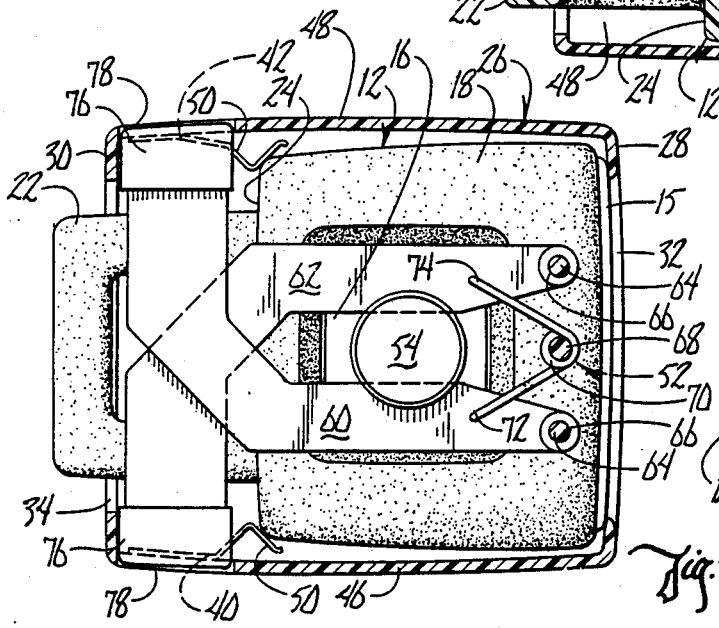
FIG. 4 is a top sectional view taken along line 4—4 in FIG. 3.
Figure 6:
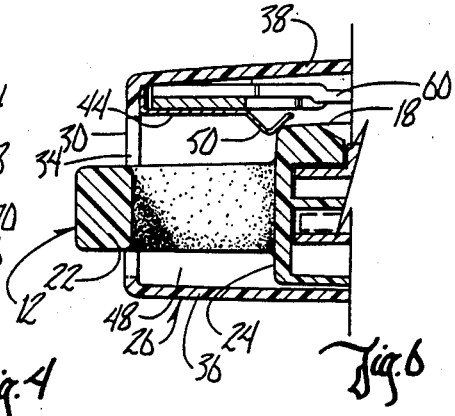
FIG. 6 is a partial side sectional view taken along line 6—6 in FIG. 2.

The buckle 12 seats within the housing, as shown in FIGS. 2–4 and 6 on bottom wall 36 in abutment against end 28 and in spaced relation from the top wall 38. The buckle is releasably secured within the housing by three spring fingers 40, 42 and 44. Spring fingers 40 and 42 are secured to the interior surfaces of the housing side walls 46 and 48 as shown in FIG. 4. Spring finger 44, shown in FIG. 6, has a turned up end secured to the interior surface of end wall 30 and extends generally horizontally interiorly therefrom. Each of the spring fingers has a flexible V-shaped end portion 50 which releasably engages a respective corner of the buckle to hold it within the housing.

Figure 5:
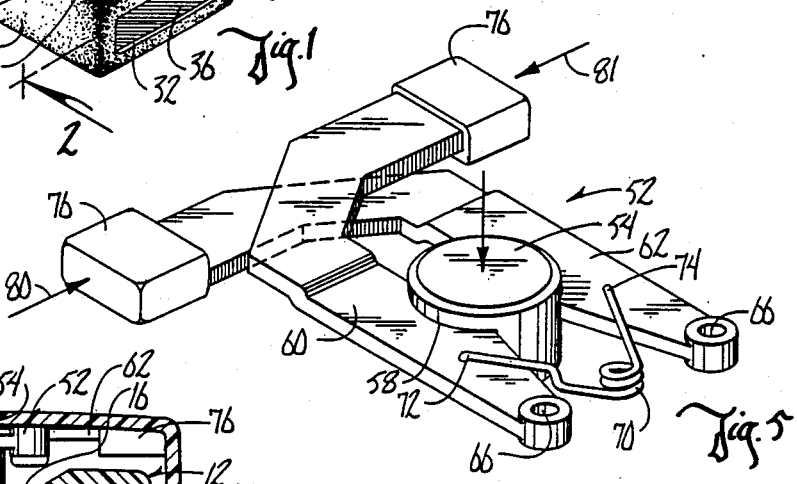
FIG. 5 is a perspective view of the spring-loaded lock finger mechanism for releasably preventing downward movement of the actuator button.

Above the buckle 12, the housing contains an actuating mechanism 52, shown alone in FIG. 5 and within the housing in FIGS. 2–4. The actuating mechanism 52 includes an actuator button 54 adapted for registration with the release button 16 of the buckle 12 for depressing the same at times. The actuator button 54 is therefore also positioned for registration with a housing top wall opening 56 so that the button can be pushed. The button has a pair of transverse slots 58 in opposite sides thereof for receiving the side edges of a pair of somewhat L-shaped lock fingers 60 and 62. Each lock finger is pivotally connected to housing top wall 38 by a rivet, bolt, integral post 64 or the like as shown in FIGS. 3 and 4. The post 64 extends through a hole 66 through the interior end of the respective finger. Another post 68 situated centrally between posts 64 is provided for supporting the central coil portion of a spring 70 having a pair of arms with downturned end portions 72 and 74 insertable into holes in the lock fingers for urging the lock fingers together into the slots 58 of the actuator button 54. The free ends of the lock fingers 60, 62 are covered with finger grip caps 76 which are normally exposed through cutout openings 78 in the housing top wall and side walls, as shown best in FIG. 1.

In operation, the seatbelt buckle 12 is inserted through opening 34 in the opposite end wall 30 to the installed position of FIGS. 2–4, whereupon the spring fingers 40, 42 and 44 releasably hold the buckle therein. It may be necessary to pinch the lock finger caps 76 together so that the actuator button 54 can be raised for vertical clearance when inserting the buckle into the housing. Upon lowering the button 54 to the extent of engagement with the seatbelt buckle release button 16, the lock fingers snap into the slots 58 for releasably holding the actuator button 54 in the locked position indicated in FIGS. 2–5. If a child presses the actuator button 52, the lock fingers 60, 62 prevent it from depressing the seatbelt release button 16. Likewise, if a child squeezes the lock finger caps 76 together, the seatbelt will not be disengaged, absent downward pressure on the actuator button 54. When an adult wishes to disengage the seatbelt, he need only pinch the lock finger caps 76 together in the direction of arrows 80 and 81 in FIG. 5 to remove the lock fingers from the actuator button slots 58 and then simultaneously depress the actuator button against the seatbelt buckle release button 16. The conventional insert tongue 82 of the male buckle 84, shown in dotted lines in FIG. 3, is then easily withdrawn from the female buckle 12 and housing 26. The return spring 86 (FIG. 3) within female buckle 12 serves to return the actuator button 54 to its locked position whereupon the lock fingers 60 and 62 snap back into the slots 58.

Figure 7:
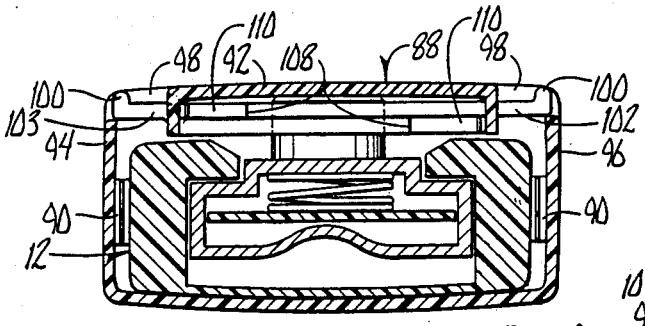
FIG. 7 is an end sectional view, similar to FIG. 2, of an alternate embodiment of the invention.
Figure 8:
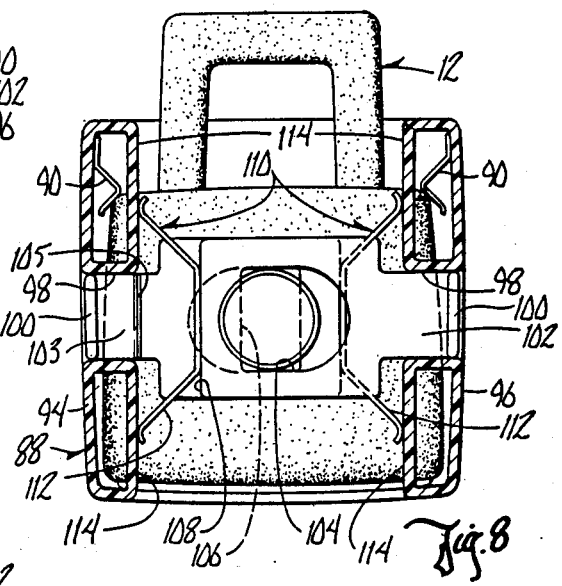
FIG. 8 is a top sectional view, similar to FIG. 4, of the embodiment of FIG. 7.
Figure 9:
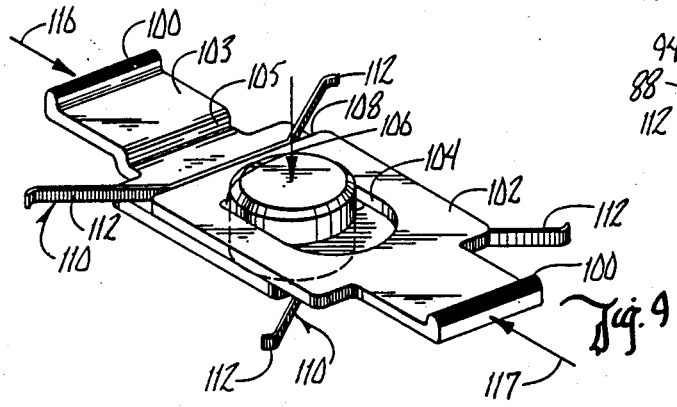
FIG. 9 is a perspective view of the lock finger mechanism for the embodiment of FIGS. 7 and 8.

A second embodiment of the invention is shown in FIGS. 7–9. The housing 88 is similarly constructed with spring fingers 90 for releasably locking the female buckle 12 within the housing but the top wall 92 and side walls 94 and 96 are provided with centrally disposed cutouts 98 for exposing the turned up finger ends 100 of a pair of lock plates 102. Each lock plate has a transversely extended slot 104 with one generally straight end 106 receivable within the slots 58 of actuator button 54. The adjacent end 108 of the lock plate 102 has a leaf spring 110 secured thereto with a pair of outwardly extended arms 112 for engaging interior side wall portions 114 formed in an upper portion of the housing as shown in FIG. 8. The lower lock plate 103 is identical to the upper lock plate but for a riser bend 105, shown in FIG. 9.

In operation, the leaf springs 110 similarly bias the lock plates 102 and 103 outwardly so that the end surfaces 106 are urged into the slots 58 of the actuator button 54 to prevent it from depressing the seatbelt release button. When it is desired to press the release button 16, one simply must simultaneously press the finger grips 100 together in the directions of 116 and 117 in FIG. 9 and push down on the actuator button 54. Again, the actuator button return spring 86 lifts the actuator button 54 back to its locked position wherein the lock plates snap back into the slots 58.

A third embodiment of the invention is shown in FIGS. 10–13. This embodiment includes no tubular housing but rather simply provides a generally channel shaped cover 118 having a top wall 120, side walls 122 and 124 which extend only partially down the side of a seatbelt buckle 12, and shallow end wall portions 126 and 128 for simply axially securing the cover 118 relative to a seatbelt buckle 12. Side wall 122 includes a pair of elongated integral straps 130 which extend around the underside of a seatbelt buckle 12 and are engageable with coacting fasteners 132 on side wall 124 for securing the device on the seatbelt buckle 12.

Top wall 120 has an opening 134 to provide access to the conventional seatbelt buckle release button 16. A latch 136 is hingedly connected to the top wall as indicated at 138 for movement between the locked position of FIGS. 10–13 substantially covering the top wall opening 134 and a release position wherein the latch is pivoted upwardly away from the top wall opening 134.

To releasably secure the latch 136 in its locked position, a pair of interiorly open sockets 140 are formed on the housing top wall at a position for receiving the free ends 142 of a pair of flexible generally L-shaped legs 144 of latch 136.

Figure 10:
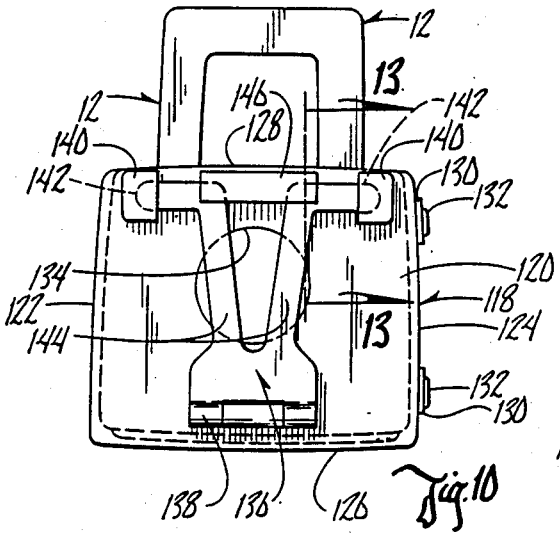
FIG. 10 is a top view of a third embodiment of the invention.
Figure 11:
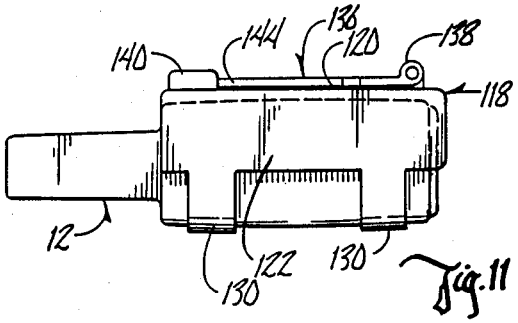
FIG. 11 is a side elevational view of the third embodiment.
Figure 12:
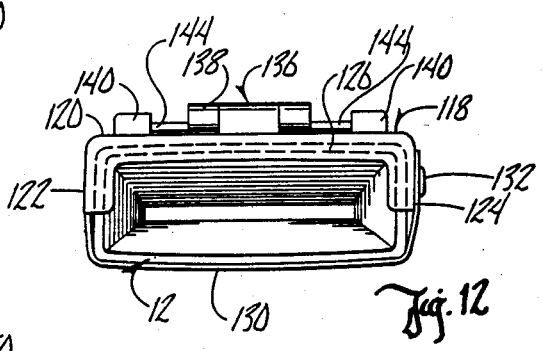
FIG. 12 is an end view of the third embodiment.
Figure 13:
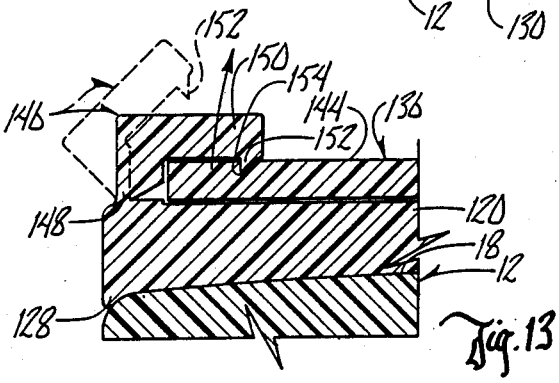
FIG. 13 is an enlarged partial sectional view taken along line 13—13 in FIG. 10.

For further protection, a flexible stop tab 146 is positioned on the housing between the sockets for engagement with the top surface of the legs 144 in the latched positions thereof as indicated in FIGS. 10 and 13. The stop tab 146 is an integral angle member including a vertical riser 148, horizontal shoulder 150 and depending ridge 152 for cooperative engagement within a pair of grooves 154 in the legs 144. Riser 148 is interiorly cut away at its lower end to facilitate upward bending movement.

In operation, the device of the third embodiment is placed over the top surface 18 of buckle 12 whereupon the straps 130 are extended across the underside of the buckle and secured to the fasteners 132. The latch 136 is pivoted downwardly with the legs 144 pinched together for passage downwardly between the sockets 140. Simultaneously, the stop tab 146 is tipped forwardly to the dotted line position in FIG. 13. Upon release of the legs 144, they spring apart into the sockets 140. The stop tab 146 is then moved to its locked position with the ridge 152 seated within the latch grooves 154. In this position, the latch 136 substantially covers the top wall opening 134 so that the release button 16 is substantially inaccessible. To release the seatbelt, one need only pinch the legs 144 together and pivot the stop tab 146 upwardly as shown in FIG. 13 to pivot the latch 136 upwardly to a release position. The seatbelt release button 16 is then readily exposed through the top wall opening 134.

Figure 14:
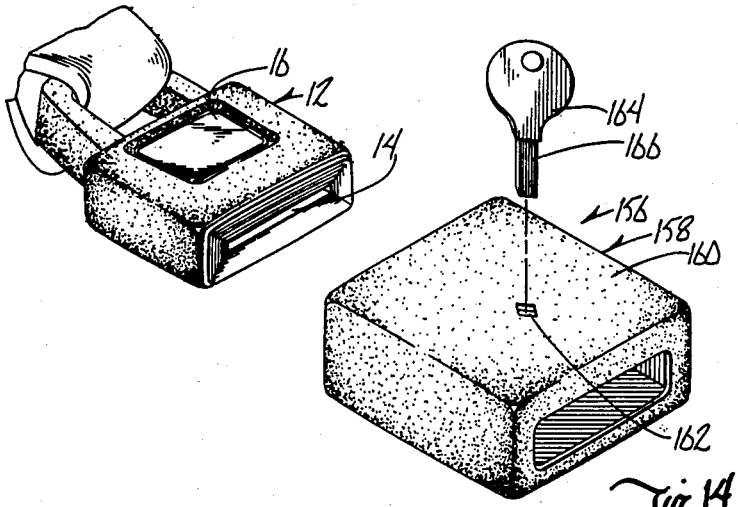
FIG. 14 is a perspective view of a fourth embodiment of the invention.

A fourth embodiment of the invention is illustrated in FIG. 14. The device 156 of this embodiment includes a generally tubular housing 158 similar to that shown in FIG. 1 but it need not be any taller than is necessary to accommodate insertion of the seatbelt buckle 12. Spring fingers like those indicated by reference numerals 40 and 42 in FIGS. 2 and 4 may be provided for releasably securing the buckle within the housing. The housing top wall 160 completely covers the seatbelt release button 16 but for a small key way 162. The key way may be diamond shaped as indicated in FIG. 14 or otherwise irregularly shaped for receiving a matched key 164. The key includes a shaft 166 having a cross-sectional shape which substantially conforms to the shape of the key way 162. Since the key way is preferably much smaller than a child's finger, the conventional seatbelt release button is substantially inaccessible except to the adult with the key 164.

Figure 15:
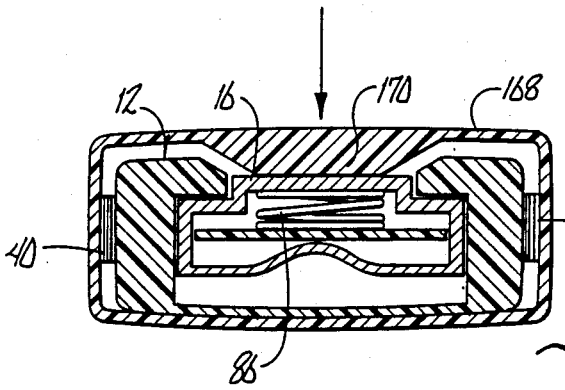
FIG. 15 is an end sectional view of a fifth embodiment of the invention.

FIG. 15 shows a fifth embodiment of the invention which is substantially identical to FIG. 14 but for the construction of the housing top wall 168. No key way is provided. Instead the top wall 168 includes a downwardly protruding thickened portion 170 positioned for registration with the seatbelt release button 16 and movable downwardly in response to downward pressure on the housing top wall 168 for actuating the release button 16. The housing is formed of a material which is sufficiently stiff that the top wall cannot be easily depressed by a child. It can be depressed by the stronger hands of an adult, however, for releasing the seatbelt.

Whereas the invention has been shown and described herein in connection with five preferred embodiments thereof, it is understood that many modifications, substitutions and additions can be made which are within the intended scope of the appended claims. For example, the latch 136 in the third embodiment could be slidably supported on the housing top wall rather than hingedly mounted.

In each of the embodiments, the seatbelt can be easily disengaged by an adult. The devices are readily adaptable to most conventional automotive seatbelts and require no modification of the existing automobile or seatbelts. The devices are child safe in that they are nontoxic, include parts that are too large for ingestion and have no sharp edges. Similarly, the smooth edges will not mar the interior of an automobile. It is preferred that materials be selected that will be workable over temperature extremes from −30° F. to 130° F. and which will stand up to abuse by children and repeated operation. The devices can be removed from the seatbelts for placement on the belts of another vehicle if desired. The devices of each embodiment operate to prevent young children from removing the seatbelt from himself or his child restraint device, while enabling an adult to easily remove the belt.

Thus there has been shown and described a child safety seatbelt securement device which accomplishes at least all of the stated objects.

I claim:

1. A child safety seatbelt securement device for use with a female seatbelt buckle of the type having an opening in one end for receiving a male seatbelt buckle therein and a depressible release button on the top surface thereof, said device comprising, a housing adapted for at least partially covering the release button of a female seatbelt buckle whereby direct access to the release button is substantially restricted, said housing having open opposite ends for permitting access to the female seatbelt buckle opening through one end and for passage of a seatbelt through the opposite end, said housing comprising an open bottomed channel member engageable over the top surface of a female seatbelt buckle and having side edges depending on each side of said female seatbelt buckle, means for securing said housing onto a female seatbelt buckle comprising strap means affixed at one end to one side edge of said channel member and engageable with the underside of a female seatbelt buckle and the other end releasably attached to the opposing side edge of said channel member, said strap means being releasable and attachable by an adult, and actuator means on said housing and actuatable by an adult for depressing the release button of a female seatbelt buckle on which said housing is secured.

2. A child safety seatbelt securement device for use with a female seatbelt buckle of the type having an opening in one end for receiving a male seatbelt buckle therein and a depressible release button on the top surface thereof, said device comprising, a housing adapted for at least partially covering the release button of a female seatbelt buckle whereby direct access to the release button is substantially restricted, said housing having open opposite ends for permitting access to the female seatbelt buckle opening through one end and for passage of a seatbelt through the opposite end, means for securing said housing onto a female seatbelt buckle, actuator means on said housing and actuatable by an adult for depressing the release button of a female seatbelt buckle on which said housing in secured, wherein said actuator means comprises an actuator button, means for supporting the actuator button on said housing above the release button of a female seatbelt buckle secured therein, and a releasable lock member movable between a locked position in engagement with said actuator button for preventing downward movement to depress the release button for preventing downward movement to depress the release button and a release position in clearance relation from the actuator button whereby the actuator button may be moved downwardly for depressing the release button.

3. The device of claim 2 further comprising a second such releasable lock member.

4. A child safety seatbelt securement device for use with a female seatbelt buckle of the type having an opening in one end for receiving a male seatbelt buckle therein and a depressible release button on the top surface thereof, said device comprising, a housing adapted for at least partially covering the release button of a female seatbelt buckle whereby direct access to the release button is substantially restricted, said housing having open opposite ends for permitting access to the female seatbelt buckle opening through one end and for passage of a seatbelt through the opposite end, means for securing said housing onto a female seatbelt buckle, actuator means on said housing and actuatable by an adult for depressing the release button of a female seatbelt buckle on which said housing is secured, wherein said actuator means comprises an actuator button, means for supporting the actuator button on said housing above the release button of a female seatbelt buckle secured therein, a releasable lock member movable between a locked position in engagement with said actuator button for preventing downward movement to depress the release button and a release position in clearance relation from the actuator button whereby the actuator button may be moved downwardly for depressing the release button, wherein said housing has a side opening and said releasable lock member comprises a lock finger having one end pivotally connected to the housing, and a forward portion accessible through said side opening for moving said lock finger between said locked position and release position.

5. The device of claim 4 wherein said lock finger and actuator button include coacting lock means for vertically securing the actuator button relative to the lock finger when the lock finger is in the locked position thereof.

6. The device of claim 5 wherein said coacting lock means includes a transverse slot in one side of the actuator button, an edge of the release finger being received in said slot when the lock finger is in the locked position thereof.

7. The device of claim 4 further comprising means for biasing the lock finger to the locked position thereof.

8. The device of claim 4 wherein said lock finger has a vertical opening therethrough at a position aligned with the actuator button in the release position of the lock finger and misaligned with the lock finger in the locked position thereof.

9. A child safety seatbelt securement device for use with a female seatbelt buckle of the type having an opening in one end for receiving a male seatbelt buckle therein and a depressible release button on the top surface thereof, said device comprising, a housing adapted for at least partially covering the release button of a female seatbelt buckle whereby direct access to the release button is substantially restricted, said housing having open opposite ends for permitting access to the female seatbelt buckle opening through one end and for passage of a seatbelt through the opposite end, means for securing said housing onto a female seatbelt buckle, actuator means on said housing and actuatable by an adult for depressing the release button of a female seatbelt buckle on which said housing is secured, wherein said actuator means comprises a large opening through said housing top wall positioned in registration with the seatbelt buckle release button, the opening large enough for an adult to actuate the release button with a finger, and a hinged latch pivotally connected to the housing for movement between a locked position substantially covering the housing top wall large opening and an actuator means releasing position pivoted upwardly away from said top wall opening.

10. The device of claim 9 further comprising releasable coacting lock means on said housing and latch member for releasably securing the latch member in the latched position thereof.

11. The device of claim 10 wherein said coacting latch means comprises socket means on said housing top wall, said latch means comprising a flexible finger insertable into said socket means in the latched position of said latch member.

12. The device of claim 11 further comprising a flexible stop tab positioned on said housing for engagement with the top surface of the latch member in the latched position thereof, said stop tab being movable out of engagement with said latch member for movement of the latch member to the release position thereof.

13. A child safety seatbelt securement device for use with a female seatbelt buckle of the type having an opening in one end for receiving a male seatbelt buckle therein and a depressible release button on the top surface thereof, said device comprising, a housing adapted for at least partially covering the release button of a female seatbelt buckle whereby direct access to the release button is substantially restricted, said housing having open opposite ends for permitting access to the female seatbelt buckle opening through one end and for passage of a seatbelt through the opposite end, means for securing said housing onto a female seatbelt buckle, actuator means on said housing and actuatable by an adult for depressing the release button of a female seatbelt buckle on which said housing is secured, and wherein said actuator means comprises a portion of the housing top wall engageable with the release button and movable downwardly in response to downward pressure on the housing top wall for actuating the release button.

14. The child safety seatbelt securement device of claim 13 wherein said portion of the housing top wall comprises a downwardly protruding thickened portion of the housing top wall.

* * * * *